US005999396A

United States Patent [19]

Streich

[11] Patent Number: 5,999,396

[45] Date of Patent: Dec. 7, 1999

[54] CIRCUIT FOR DRIVING A CONTACTOR

[75] Inventor: Bernhard Streich, Amberg, Germany

[73] Assignee: Siemens Aktiengesellschaft, München, Germany

[21] Appl. No.: 08/894,576

[22] PCT Filed: Feb. 12, 1996

[86] PCT No.: PCT/DE96/00221

§ 371 Date: Oct. 13, 1997

§ 102(e) Date: Oct. 13, 1997

[87] PCT Pub. No.: WO96/26528

PCT Pub. Date: Aug. 29, 1996

[30] Foreign Application Priority Data

Feb. 24, 1995 [DE] Germany ..... 295 03 146 U

[51] Int. Cl.[6] ..... H01H 47/32

[52] U.S. Cl. ..... 361/194; 361/154

[58] Field of Search ..... 361/152, 154, 361/160, 194, 170

[56] References Cited

U.S. PATENT DOCUMENTS 3,786,314 1/1974 Misch ..... 361/154

3,852,646 12/1974 Mason ..... 361/154

4,291,358 9/1981 Dettmann et al. ..... 361/154

4,620,261 10/1986 Thornton ..... 361/154

5,621,603 4/1997 Adamec et al. ..... 361/154

*Primary Examiner*—Fritz Fleming

*Attorney, Agent, or Firm*—Kenyon & Kenyon

[57] ABSTRACT

The circuit on which the present invention is based has a control circuit in which a switching element and a measurement resistor are connected in series with the contactor coil. A pickup current control circuit picks up the voltage at measurement resistor and controls the switching element after comparison with a reference voltage. By parallel connection of an additional shunt resistor with measurement resistor, a current approximately twenty to thirty times higher can be achieved during the pickup phase than the holding phase by setting only a single reference voltage. In the holding phase the parallel circuit is disabled so that only the measurement resistor is operative.

4 Claims, 2 Drawing Sheets

CIRCUIT FOR DRIVING A CONTACTOR

The invention concerns a circuit for driving a contactor, where a controllable switching element, a measurement resistor and the contactor coil are connected in series to a control voltage source in the control circuit of the contactor, and a pickup current control circuit is provided to pick up the voltage on the measurement resistor.

Figure 2:
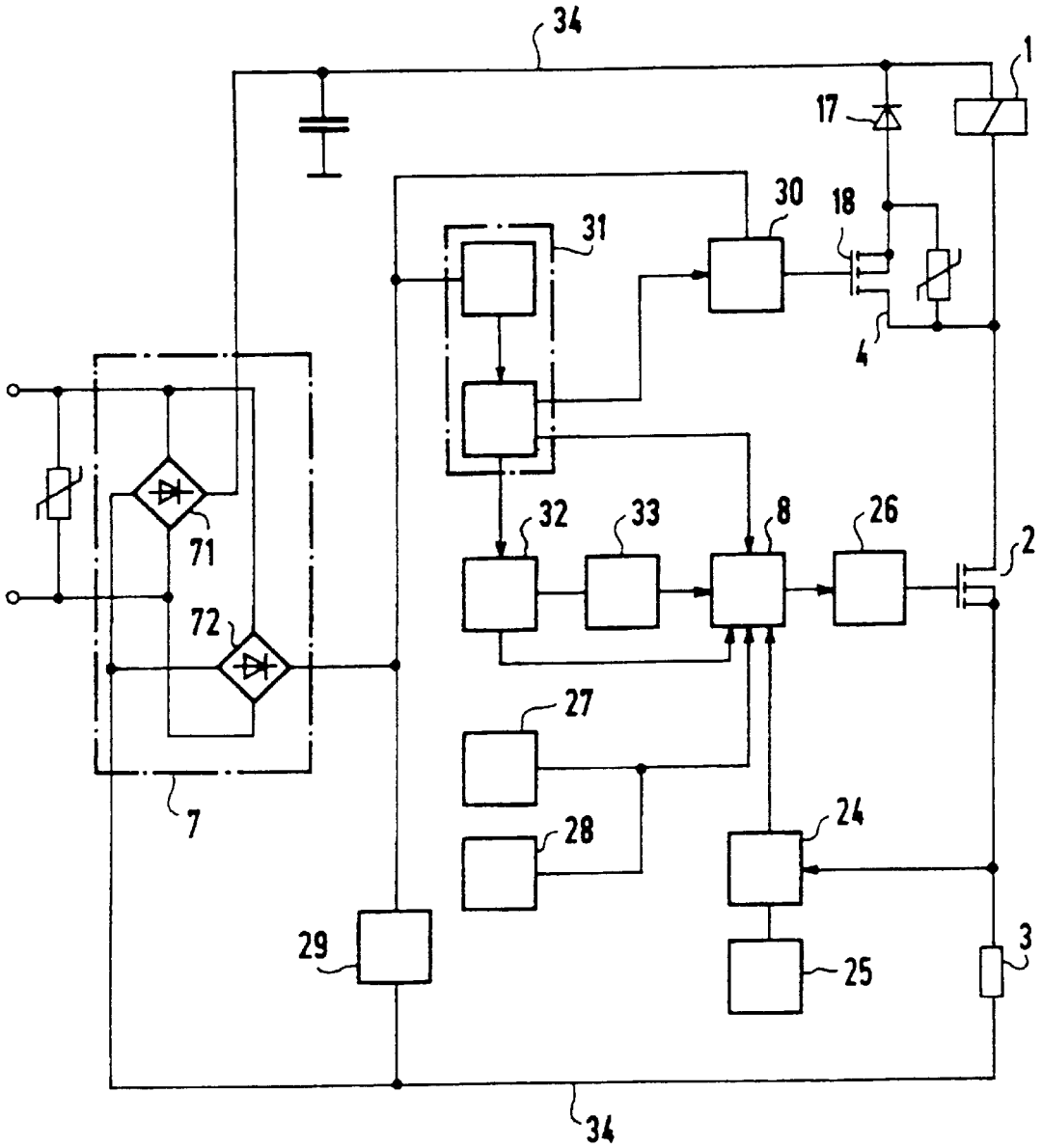

A circuit of this type is disclosed in German Offenlegungsschrift No. 43 21 252. Control circuit 34 of a contactor as illustrated in FIG. 2 here comprises a rectifier block 7 of a control voltage source and a contactor coil 1, a switching element 2 and a measurement resistor 3 connected in series. A pickup current control circuit 24 that is in operative connection with switching element 2 via a logic element 8 is connected to measurement resistor 3; logic element 8 is connected to switching element 2 by a driver stage 26. In addition, a setpoint device 25 is connected to pickup current control circuit 24 to supply a reference voltage. Logic element 8 is also connected to a programmable control device 27 and a mechanical actuator 28. In addition, logic element 8 is also connected from a voltage shaping circuit 31 to a pulse width modulator 33 either directly or via a time control device 32.

Rectifier block 7 contains a first bidirectional rectifier 71 to which control circuit 34 is connected and a second bidirectional rectifier 72 that supplies a supply circuit for the voltage shaping circuit 31 and a free-wheeling control 30. Furthermore, this supply circuit also includes a power supply device 29 that supplies the operating voltage for all the consumers of the circuit that are not supplied directly from rectifier block 7.

A free-wheeling arm 4 is connected to contactor coil 1. A free-wheeling switching element 18 and a free-wheeling diode 17 are connected in series in this free-wheeling arm 4. Free-wheeling control 30 is connected to the control input of free-wheeling switching element 18. Free-wheeling control 30 is in signal connection with voltage shaping circuit 31.

The circuit works in such a way that a control current flows in control circuit 34 as soon as a corresponding control signal from a master control is switched to control circuit 34. Due to the fact that contactor coil 1 is under a current, the contactor picks up. The pickup current is then kept constant by the fact that a measurement voltage proportional to this pickup current is picked up at measurement resistor 3 and sent to pickup current control circuit 24 containing a comparator. The comparator compares the measurement voltage with a reference voltage of setpoint adjusting device 25. The switching threshold of the comparator can be changed by adjusting the reference voltage level. The selectable reference voltage corresponds to the respective pickup current. The holding current, which is smaller than the pickup current by a factor of 20 to 30, is achieved by means of the pulse width modulator, that is connected to logic element 8. ON time periods of switching element 2 of varying duration are achieved by pulse width modulation corresponding to the control voltage applied to the voltage divider at each instant, and in this way a relatively lower holding current is achieved.

The pulse width modulator requires a plurality of components, including a monoflop and an oscillator plus an RC element. From the standpoint of an inexpensive solution, it would be a great advantage to be able to do without the pulse width modulator.

Therefore, the object of this invention is to create a circuit of the above-mentioned type that will be inexpensive and will require only a few components.

This is achieved according to this invention by a circuit of the above-mentioned type where a series connection of an additional electronic switching element and an additional resistor is in parallel with the measurement resistor.

Advantageous embodiments of this invention are characterized in subclaims 2 through 4.

Figure 1:
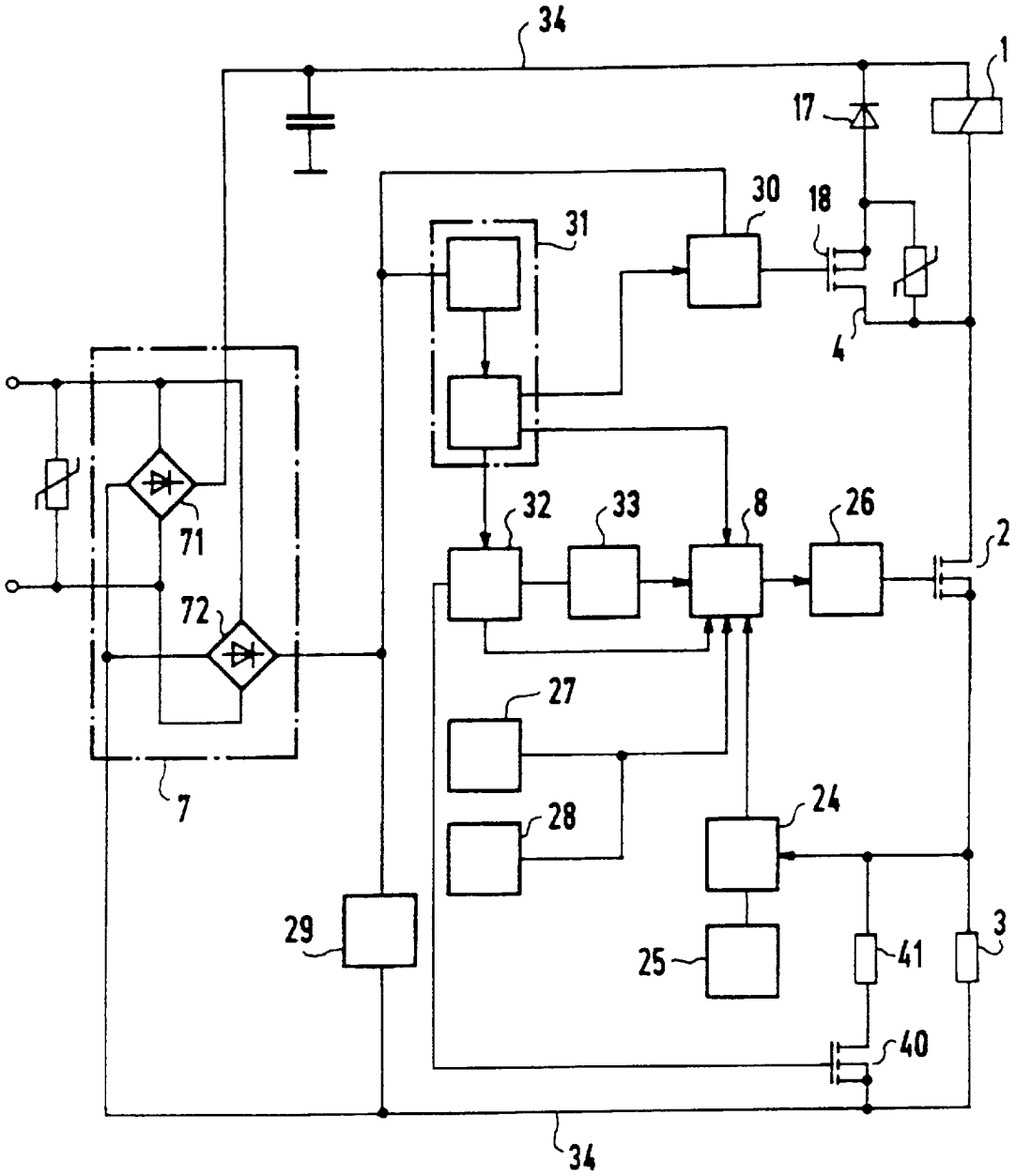

One embodiment of this invention is explained in greater detail below with reference to FIG. 1. The circuit illustrated here corresponds largely to the circuit according to FIG. 2 as described in the description introduction, so that only the deviations relevant to this invention will be described here. The circuit according to the invention does not have a pulse width modulator 33, and instead, in parallel with measurement resistor 3 it has a series connection of an ohmic resistor 41 and an electronic switching element 40 driven by time control device 32. Independently of the pickup phase or holding phase, the reference voltage in pickup current control circuit 24, which is set by setpoint device 25, is always the same. A switchable shunt in the form of the two resistors 3, 41 that can be connected in parallel is used for switching between the pickup phase and the holding phase. To obtain the higher current for the pickup phase, both shunt resistors 3, 41 are switched in parallel by means of switching element 40, e.g., a switching transistor.

The following discussion concerns the function of the circuit. After the contactor has been switched on, a replica of the control voltage at a lower level is produced in the voltage shaping circuit and then the mean voltage is formed and supplied to a voltage ramp. When the starting threshold of the voltage ramp is reached, the pickup phase, which may last 100 ms, for example, is initiated by time control device 32, which drives logic element 8, which closes switching element 2 via driver stage 26. Switching element 40, e.g., a switching transistor, is also closed for the pickup phase and its ON time for the pickup phase is also set by time control device 32. Due to the parallel connection of the two shunt resistors 3, 41, a much higher current flows in the pickup phase on reaching the reference voltage defined by setpoint device 25 than in the holding phase which follows after 100 ms, when switching transistor 40 is opened. Thus, any desired ratio of pickup current to holding current can be achieved with a single reference voltage through appropriate tuning of the two shunt resistors 3, 41.

What is claimed is:

1. A circuit arrangement for driving a contactor, comprising:

a control circuit, the control circuit including:

a first switching element, a first measurement resistor, a contactor coil, a second switching element, a second resistor, wherein the first switching element, the first measurement resistor, and the contactor coil are coupled together in a first series connection, wherein the first series connection includes a connection to a control voltage source, and wherein the second switching element and the second resistor are coupled together in a second series connection, the second series connection being connected in parallel to the first measurement resistor; and a pickup current control circuit for picking up a voltage of the first measurement resistor.

2. The circuit arrangement according to claim 1, further comprising a time control device coupled to the second switching element, wherein the time control device sets a duration of an on state of the second switching element.

3. The circuit arrangement according to claim 2, wherein the time control device triggers the on state of the second switching element only during a pickup phase of the contactor.

4. The circuit arrangement according to claim 3, wherein when the pickup phase is at a starting threshold, a pickup current flowing through the contactor coil induces the same voltage level in the first measurement resistor as when a holding current flows through the contactor coil and the first measurement resistor during a holding phase, and wherein the voltage level corresponds to a reference voltage that is set by the pickup current control circuit.

* * * * *